United States Patent [19]

Lawrence et al.

[11] Patent Number: 5,009,342

[45] Date of Patent: Apr. 23, 1991

[54] DUAL LIQUID SPRAYING ASSEMBLY

[75] Inventors: Ronald L. Lawrence, San Diego, Calif.; Mark R. Miller, 680 Brotherton, Escondido, Calif. 92025

[73] Assignees: Mark R. Miller; Steven J. Berling, both of Escondido, Calif.

[21] Appl. No.: 393,292

[22] Filed: Aug. 14, 1989

[51] Int. Cl.[5] ..... B61D 5/00

[52] U.S. Cl. ..... 222/136; 222/145; 222/383

[58] Field of Search ..... 222/136, 145, 144.5, 222/134, 94, 383; 239/304, 305, 407, 419, 417.5

[56] References Cited

U.S. PATENT DOCUMENTS

| | | | |
|---|---|---|---|
| 2,941,696 | 6/1960 | Homm | 222/136 |
| 3,200,995 | 8/1965 | Gangwisch | 222/94 |
| 3,325,056 | 6/1967 | Lewis | 222/136 |
| 3,416,709 | 12/1968 | Schultz et al. | 222/94 |
| 3,722,750 | 3/1973 | Fox, Jr. | 222/94 |
| 3,760,986 | 8/1970 | Castner et al. | 222/145 |
| 4,355,739 | 10/1982 | Vierkotter | 222/134 |
| 4,432,469 | 2/1984 | Eble et al. | 222/134 |
| 4,585,149 | 4/1986 | Zulauf | 222/94 |
| 4,750,644 | 6/1988 | Kolody | 222/144.5 |
| 4,821,923 | 4/1989 | Skorka | 222/80 |
| 4,838,457 | 6/1989 | Swahl et al. | 222/94 |

*Primary Examiner*—Michael S. Huppert
*Assistant Examiner*—P. Derakshani
*Attorney, Agent, or Firm*—Brown, Martin, Haller & McClain

[57] ABSTRACT

A dual liquid spraying assembly comprises an outer container containing at least two separate compartments for two different liquids, a spray pump dispenser for mounting on the outlet of the container, and a valve assembly mounted between the compartments and the spray pump dispenser for controlling the proportions of the different liquids dispensed. The valve assembly comprises an inner valve member having a discharge outlet for connection to the spray pump dispenser and at least two inlets for connection to the respective compartments, and an outer, control sleeve rotatably mounted on the inner valve member for controlling connection of the inlets to the outlet. Both the inner and outer valve members are releasably secured on the outlet of the container to extend co-axially with the outlet opening.

19 Claims, 2 Drawing Sheets

DUAL LIQUID SPRAYING ASSEMBLY

BACKGROUND OF THE INVENTION

The present invention relates generally to liquid dispensers comprising a container for liquid and a spraying device secured to the container for dispensing a spray of liquid, and is particularly concerned with dispensers for dispensing at least two different liquids.

Various containers for dispensing several different materials have been proposed in the past. For example, U.S. Pat. No. 4,355,739 of Vierkotter describes a liquid storage container having two separate compartments for connection to a spray pump for selectively dispensing material from the compartments. An external selector is connected to a valve assembly for controlling the ratio of the two different components dispensed from the pump. The valve assembly includes a rotatable member which controls the size of inlet openings to the valve assembly from the different compartments. This arrangement is relatively complex and expensive to manufacture, involving a specially manufactured container having separate internal compartments and a number of different parts. Separation of the parts for refilling purposes is not straightforward in view of the various internal passageways extending across and along the container.

SUMMARY OF THE INVENTION

It is an object of this invention to provide an improved dual liquid spraying system.

According to the present invention, a liquid spraying assembly for selectively dispensing at least two different liquids is provided, which comprises an outer container containing at least two separate compartments for accommodating two different liquids, a spray pump assembly mounted on the container for selectively dispensing liquids from the compartments, and a valve assembly connected between the compartments and the spray pump assembly for controlling the proportions of the two different liquids dispensed. The valve assembly comprises a first, inner valve member having an outlet for connection to the spray pump assembly, a first inlet connected to one of the liquid compartments, and a second inlet connected to the other liquid compartment, and a second, outer, control valve member for controlling connection of the inlet to the outlet. The valve members are relatively rotatable between first and second positions in which only the first inlet is connected to the outlet and only the second inlet is connected to the outlet, and at least one intermediate position in which both of the inlets are connected to the outlet. Preferably, movement of the control member relative to the first valve member between the first and second positions gradually varies the relative sizes of the two inlets so as to vary the ratio of the two liquids dispensed.

Preferably, the valve assembly is removably mounted coaxially on the neck of the container. In one embodiment of the invention, the container itself has a dividing wall separating it into two compartments, with the first and second inlets on the valve assembly aligned with the respective compartments. Preferably, liquid draw tubes extend from the valve inlets into the respective compartments. In an alternative embodiment, a removable reservoir member extends into the container, the member having an internal chamber for containing a first fluid, a first inlet at one end connected to the internal chamber, a second inlet at the same end, and an outlet communicating with the interior of the container surrounding the reservoir member, the second inlet being connected to the outlet. When the reservoir member is mounted on the container with the valve assembly in place, the first inlet is connected to the first inlet of the valve member while the second inlet is connected to the second inlet of the valve member. This arrangement allows a standard, off-the-shelf bottle to be used as the outer container, reducing expense.

In the preferred embodiment of the invention, the inner valve member discharge outlet and the two inlets are each connected via internal passageways to spaced first, second and third openings, respectively, on an outer surface of the inner valve member which is in mating engagement with an internal surface of the outer valve member, the internal surface having an indented passageway or groove for controlling the connection of the external openings on the inner valve member. The passageway is arranged such that, as the outer valve member is rotated, it moves between a position in which the first opening is connected only to the second opening, a position in which the first opening is connected only to the third opening, and at least one position in which both the second and third opening are connected to the first opening, and thus to the discharge outlet, via the passageway.

In a preferred embodiment of the invention, the first valve member comprises a generally cylindrical housing for securing to the neck of a container, and the control member comprises a cylindrical outer sleeve rotatably mounted on the housing. The outlet is connected to a first, mixing chamber in the housing while the first and second inlets are connected to respective first and second, axially spaced fluid chambers in the housing. The mixing chamber has an inlet or first opening which extends around part of the outer periphery of the housing, while each of the fluid chambers have axially spaced outlet or second and third openings which also extend around part of the outer periphery of the housing, each outlet opening being aligned with a different part of the inlet opening and also being in partial alignment with the other inlet opening.

The control sleeve has an internal, axially extending passageway for controlling connection of the respective outlet openings to the inlet opening according to its position relative to these openings. In the intermediate position, it is located so as to extend over the aligned portions of the outlet openings as well as the inlet opening. In the first and second positions, it is located to extend over one of the outlet openings only so as to connect only one of the chambers to the mixing chamber. Preferably, each of the outlet openings is tapered to allow a gradual change in the relative proportions of the two liquids dispensed as the control member is rotated. This permits a large range of fine control over the relative proportions, and is particularly useful when two liquids of different viscosity are to be mixed and dispensed, for example oil and water. By suitably adjusting the position of the control ring or sleeve, the outlet opening for the higher viscosity liquid can be made larger than that for the lower viscosity liquid, to compensate for their different flow rates and provide better mixing.

According to another aspect of the invention, a valve assembly for controlling the mixing and dispensing of two different liquids from a spray pump is provided, which comprises inner and outer relatively rotatably valve members, the inner member having an outlet at one axial end for receiving the suction tube of a spray pump, and a pair of inlets at the opposite axial end for receiving first and second suction tubes, respectively, for extending into separate liquid compartments. The outlet is connected to a mixing chamber in the inner valve member, and the outer valve member controls the connection of the inlets to the mixing chamber. The outer valve member is movable relative to the inner member between positions in which only one of the inlets is connected to the outlet and in which both of the inlets are connected to the outlet. Preferably, the assembly includes a first releasable coupling device for releasably mounting the valve assembly on the open end of a container having separate liquid compartments, and a second releasable coupling device for releasably mounting a spray pump on the inner valve member. The outer valve member is rotatably mounted on the inner member.

The valve assembly can be co-axially mounted on the neck of a standard container, or a specialized container having separate liquid compartments, and is of relatively simple, inexpensive construction requiring only few specialized parts. The valve assembly or unit is completely separate from the bottle or liquid container, and can be attached to any container having separate compartments for different liquids.

BRIEF DESCRIPTION OF THE DRAWINGS

The present invention will be better understood from the following detailed description of some preferred embodiments, taken in conjunction with the accompanying drawings, in which like reference numerals refer to like parts, and in which.

DESCRIPTION OF THE PREFERRED EMBODIMENTS

Figure 1:
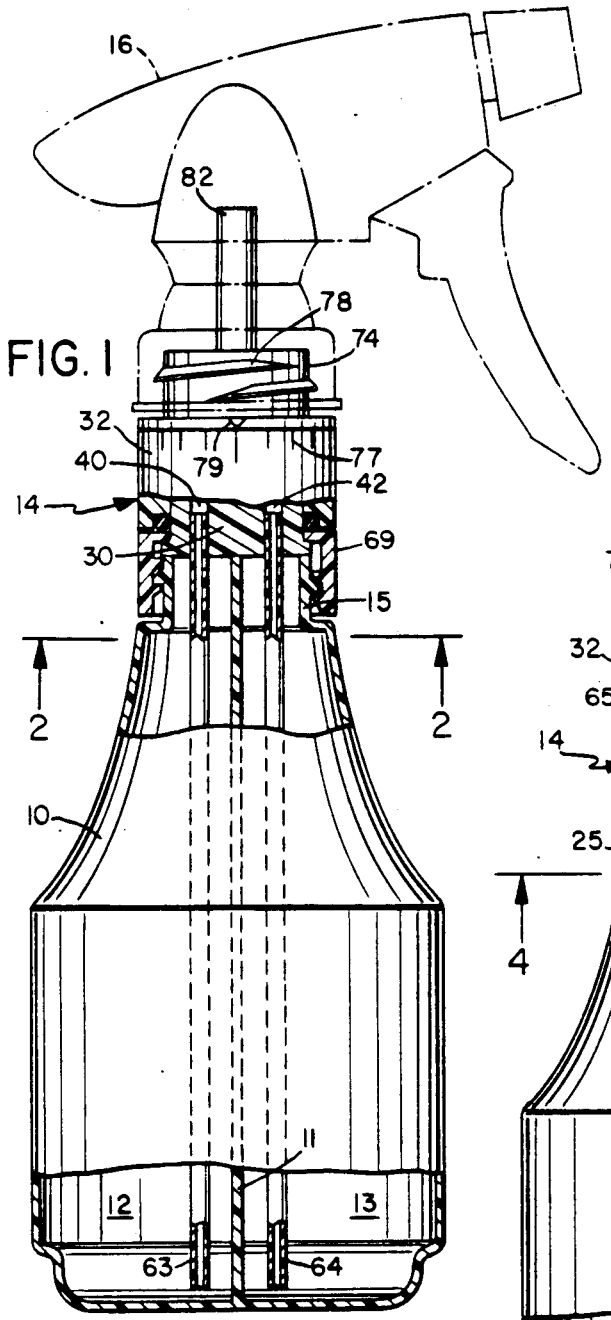
FIG. 1 is a side elevation view, with portions cut away, of a dual liquid spraying assembly according to a first embodiment of the invention.
Figure 2:
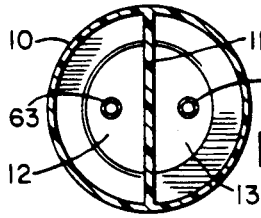
FIG. 2 is a sectional view taken on line 2—2 of FIG. 1.

FIGS. 1 and 2 of the drawings illustrate a dual liquid spraying assembly according to a first embodiment of the invention. The assembly basically comprises a bottle or container 10 having an internal wall 11 dividing it into two separate liquid compartments 12, 13, and a valve assembly 14 mounted on the neck or open end 15 of the container for controlling the proportions of two different liquids contained in compartments 12 and 13 dispensed via spray pump head 16.

Figure 4:
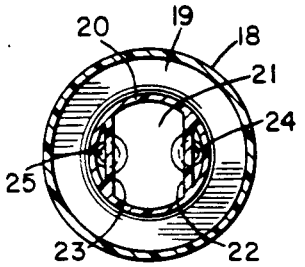
FIG. 4 is a sectional view taken on line 4—4 of FIG. 3.
Figure 3:
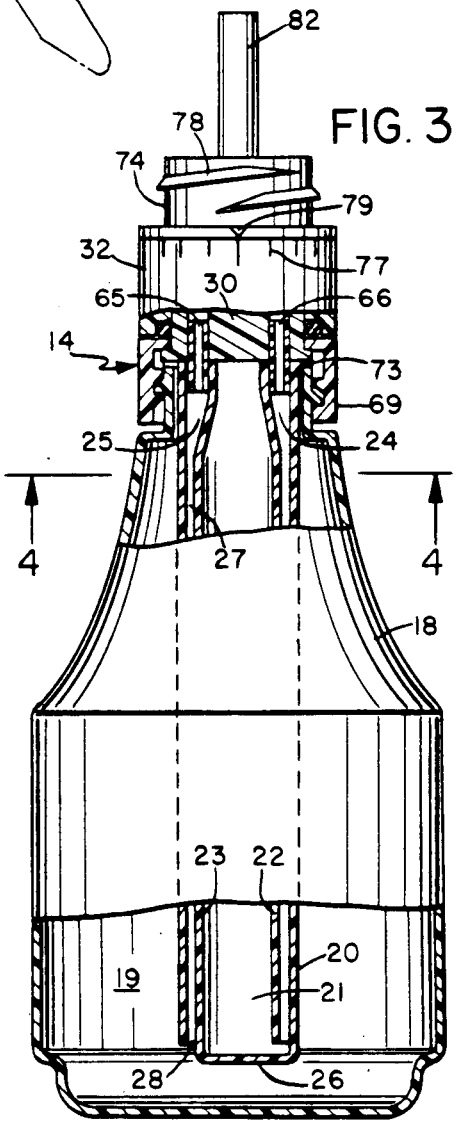
FIG. 3 is a view similar to FIG. 1, with an alternative type of bottle.

FIGS. 3 and 4 illustrate a modified embodiment in which a standard bottle 18 having a single internal compartment 19 is used in place of split bottle 10, and a special reservoir 20 is seated at one end on the neck 15 of bottle 18 and extends into the bottle towards its bottom end to provide separate liquid compartments. The reservoir 20 defines a first internal chamber 21 for a first liquid. Spaced, parallel internal dividing walls 22, 23 extend along the length of reservoir and communicate with outlet openings 24, 25 at the upper end of the reservoir. One of the walls 22 terminates short of the lower end 26 of reservoir 20 to connect one of the outlet openings 24 with internal chamber 21. The other inner wall 23 extends to the lower end 26 of the reservoir and defines a passageway 27 communicating with an opening or cut out 28 at the lower end of the outer wall of the reservoir to connect the interior 19 of bottle 18 with the other outlet opening 25 via passageway 27, the interior of the bottle thus forming a separate chamber for containing a different liquid. This arrangement allows any standard, off-the-shelf bottle to be used for a dual liquid dispenser, considerably reducing manufacturing expense since no specialized bottles need to be produced.

Figure 5:
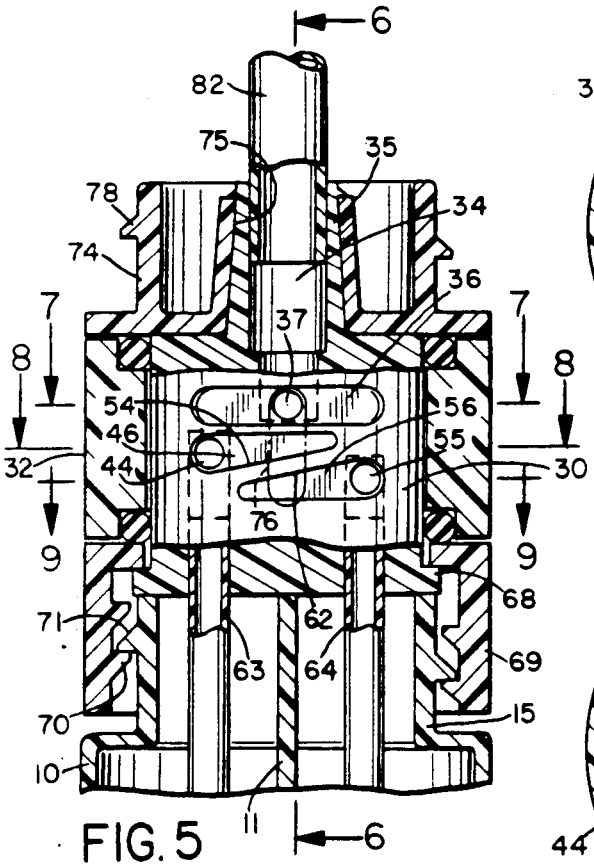
FIG. 5 is an enlarged view of a potion of FIG. 1, with further elements cut away to reveal the valve structure.
Figure 7:
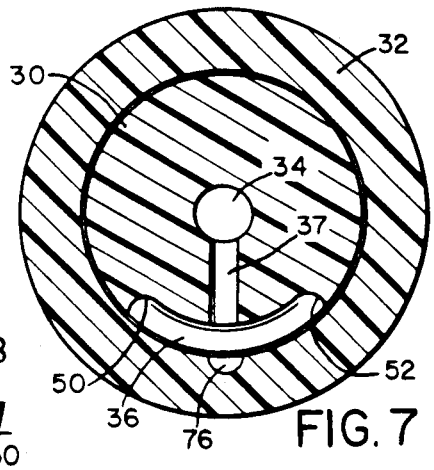
FIG. 7 is a sectional view taken on line 7—7 of FIG. 5, with the valve in the equal dual flow position.
Figure 6:
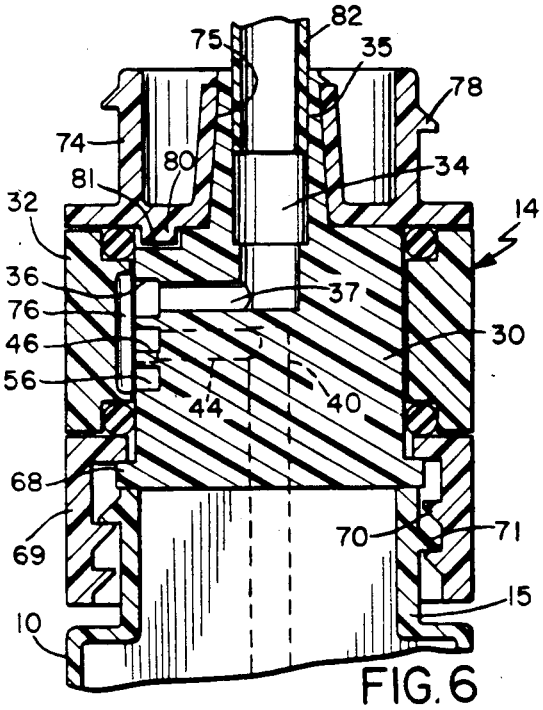
FIG. 6 is a sectional view taken on line 6—6 of FIG. 5.

The valve assembly used in both embodiments is the same, and like reference numerals have been applied where appropriate. The valve assembly is best illustrated in FIGS. 5 to 8, and basically comprises an inner, cylindrical valve member or manifold 30 and an outer, cylindrical control sleeve 32 rotatably mounted on valve member 30. The inner valve member 30 has a discharge outlet 34 in stem or spigot 35 which projects coaxially from one axial end of the member 30. Outlet 34 communicates via radial passageway 37 with mixing chamber 36 in member 30 which is formed by a groove extending around part of the outer periphery of member 30, as best illustrated in FIGS. 6 and 7. Thus chamber 36 opens radially outwardly from member 30 (see FIG. 6) to define an elongate inlet opening to chamber 36.

Axially extending inlet passageways 40, 42 are provided at the opposite axial end of member 30. The first inlet passageway communicates via transverse passageway 44 with a first liquid chamber 46 in member 30 which is axially spaced below mixing chamber 36. Chamber 46 is also formed by an annular groove extending around part of the outer periphery of member 30 to define an elongate outlet opening from chamber 46 in the outer surface of member 30. The outlet opening is aligned at one axial end 48 with a first end 50 of mixing chamber 36 (see FIG. 5). Chamber 46 is shorter than the mixing chamber 36, so that it terminates short of the opposite end 52 of the mixing chamber, as best illustrated in FIG. 5. Chamber 46 is tapered in height gradually from its end 48 towards its opposite end by means of inclined lower chamber wall 54 (see FIG. 5).

Figure 9:
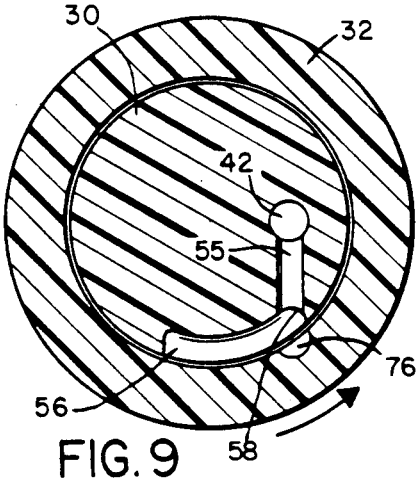
FIG. 9 is a sectional view taken on line 9—9 of FIG. 5, with the valve in a single chamber flow position.

The second inlet passageway 42 communicates in a similar manner via transverse passageway 55 with a second fluid chamber 56, as best illustrated in FIG. 9. Fluid chamber 56 comprises an annular groove extending around part of the outer periphery of member 30 and defining an elongate outlet opening from chamber 56 in the outer wall of member 30. Chamber 56 is spaced axially below first fluid chamber 46. A first end 58 of chamber 56 is aligned with the opposite end 52 of mixing chamber 36 to chamber 46, and is of equivalent length to chamber 46 so that it terminates short of the first end 50 of chamber 36. Chamber 56 is also gradually tapered in height along its length by means of inclined upper wall 62 which is of the same angle as the lower wall 54 of the adjacent first fluid chamber 46. Central portions of all three chambers 36, 46 and 56 are thus in axial alignment (see FIG. 5), while an end portion of the chamber 46 is in alignment with a first end portion of chamber 36 and an end portion of the other chamber 56 only is in alignment with the opposite end portion of chamber 36.

The two axially extending inlet passageways 40, 42 are designed to receive respective liquid draw tubes for extending into two different liquid chambers. In the case of the split container 10 of FIG. 1, the draw tubes 63, 64 extend to a position close to the lower end of bottle 10. In the embodiment of FIGS. 3 and 4, shorter draw tubes 65, 66 are used which extend only into the respective outlet openings 24, 25 in the upper end of reservoir 20, with the internal passageways connecting these openings to the respective chambers 19 and 21 acting as elongations of the suction or draw tubes.

The inner valve member has an annular flange 68 at its lower end and is secured on the neck or open end 20 of a bottle 10 or 18 by means of fitting nut 69 which has internal screw threads 70 for threaded engagement with the external threads 71 on the neck of the bottle. In the embodiment of FIG. 3, the fitting nut simultaneously clamps flange 68 at the lower end of valve member 30 and flange 73 at the upper end of reservoir 20 onto the upper end of the neck 20 of the bottle.

A threaded retainer 74 having a through bore 75 for snap fitting onto spout or stem 35 is mounted on the valve member as illustrated in FIGS. 5 and 6. The control ring or sleeve 32 is retained on the valve member 30 between retainer 74 and fitting nut 69 with sufficient free play to allow it to be rotated relative to member 30. Sleeve 32 has an internal, axially extending groove or connecting passageway 76 for controlling the connection of outlet openings from chambers 46 and 56 to inlet opening of chamber 38, as will be explained in more detail below. An external scale 77 may be provided on the outer surface of control ring 32, as best illustrated in FIGS. 1 and 3, for alignment with an arrow indicator 79 on retainer 74 to indicate the relative proportions of the two liquids dispensed, as will be explained below. Retainer 74 may have a suitable anti-rotation connection with inner valve member 30, for example a tongue or projection 80 which engages a corresponding slot 81 on the upper face of valve member 30.

Retainer 74 has external screw threads 78 sized for threaded engagement with internal screw threads (not illustrated) of a standard spray pump head 22 of the type commonly used on single liquid spray dispensers for liquids such as cleaning fluids, as illustrated in FIG. 1. A draw tube 82 projects from the pump mechanism into the discharge outlet or passageway.

Operation of the valve unit 14 is identical for both the split bottle 10 of FIGS. 1 and 2 and the standard bottle 18 with reservoir 20 as illustrated in FIGS. 3 and 4. The operation will best be understood with reference to FIGS. 5 to 9. Before mounting the valve assembly on the neck of bottle 10 or 18, the separate chambers 12 and 13 or 19 and 21 within the bottle are filled with two different liquids A and B to be dispensed, for example a concentrated cleaning liquid and water, suntan oil and water, or other liquids to be dispensed either separately or as a mixture of varying concentration. The valve assembly allows the mixing ratio or relative proportions of the two liquids dispensed to be controlled. Where a reservoir 20 is used as in FIGS. 3 and 4, a higher viscosity liquid will normally be stored inside reservoir 20 if the two liquids are of widely different viscosity.

Figure 8:
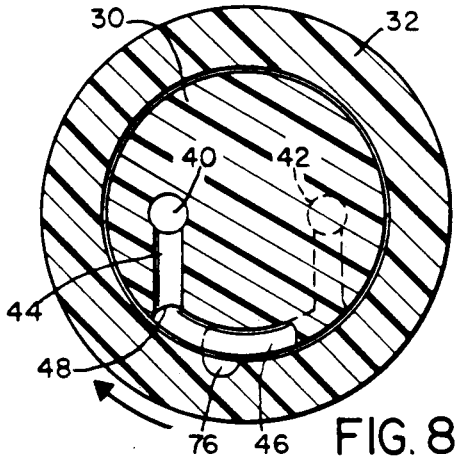
FIG. 8 is a sectional view taken on line 8—8 of FIG. 5, with the valve in an unequal dual flow position.

The outer control ring 32 controls the dispensing of the two liquids by positioning of connecting passageway 76 relative to the two liquid chambers 46 and 56 in valve member 30. The first liquid chamber will be connected via one of the draw tubes 63 or 65 to the liquid A in one of the compartments 12 or 19 within the bottle, While the other liquid chamber 56 will be connected via the other draw tube 64 or 66 to the liquid B in the other compartment 13 or 21. The control ring 32 can be rotated relative to the valve member 30, and thus relative to the liquid chambers, so as to move the passageway relative to the chambers 36, 46 and 56 as generally indicated in FIGS. 7, 8 and 9. When the passageway is located adjacent a first end 50 of the mixing chamber 36, it will also extend over or overlap the end portion of the first fluid chamber 46, connecting chamber 46 to mixing chamber 36. However, it will not overlap second fluid chamber 56 in this position, so that if the spray pump is actuated in this position, only liquid A will be dispensed.

If the control ring is moved from this position to the position illustrated in FIG. 9, where the passageway 76 is located adjacent the opposite end 52 of the mixing chamber 36, the passageway will connect the aligned end portion 58 of the second fluid chamber 56 with the mixing chamber. Since passageway 76 does not overlap the first fluid chamber 46 in this position, actuation of the spray pump with the ring in the position shown in FIG. 9 will result in dispensing of only liquid B.

When the control ring is moved to move the passageway 76 between these two extreme positions, which will correspond to opposite ends of the scale in FIGS. 1 and 3, different proportions of the two liquids will be dispensed as determined by the tapered outlets from the two liquid chambers resulting from the inclined lower and upper chamber walls 54 and 62, respectively. At the mid point position of passageway 76 illustrated in FIG. 7, the passageway overlaps portions of chambers 46 and 56 of approximately equal height, as can be seen in FIG. 5, to form outlet openings of approximately equal area. Thus, in this position, equal quantities of liquids A and B will be dispensed when the spray pump is actuated, assuming they are of approximately equal viscosity.

As the ring 32 is rotated in a clockwise direction from the position illustrated in FIG. 7, the amount of liquid B dispensed will gradually decrease due to the reduction in the effective area of the outlet opening defined by the overlap of passageway 76 with gradually reducing height portions of chamber 56. At the same time, the amount of liquid A dispensed will gradually increase, due to the overlap of passageway 76 with increasing height portions of chamber 46. FIG. 8 illustrates one possible intermediate position of ring 32 when moved to the left from the position illustrated in FIG. 7. Rotation of the ring in an anti-clockwise direction from the mid point position of FIG. 7 will have the opposite effect, gradually reducing the proportion of liquid A dispensed while increasing the proportion of liquid B. This arrangement allows relatively fine metering of the proportions of the two liquids dispensed. Additionally, it permits the metering to be varied to compensate for liquids of widely varying viscosities. For example, where one of the liquids has relatively high viscosity, such as oil, while the other liquid is of low viscosity, such as water, the control ring can be positioned to effectively increase the size of the opening connecting the high viscosity liquid to the mixing chamber while decreasing the size of the opening connecting the lower viscosity liquid, which will flow more easily, to the mixing chamber. This will overcome or reduce the problems in spray dispensing two liquids of widely different viscosities. The user can regulate the dispensed mixture by moving the control ring to an optimum position.

Where the two liquids are a concentrated sun tan oil and water, the dispenser can be used to change the protection factor of the dispensed mixture by increasing or decreasing the proportion of water. The scale 77 may then be marked with concentrations or a coding corresponding to the various control ring positions. Alternatively, the two liquids may, for example, comprise sun tan oils having different protection factors so that the user can vary the effective protection factor by altering the relative proportions according to varying protection factors which may be marked on the scale.

The dual liquid spraying apparatus described above is less complex and less expensive than previous multiple liquid dispensers. It allows much finer control of the relative proportions of two liquids dispensed. The ratio of the liquid components can be varied using this dispenser from around 10:1 to 0:1 in both directions, dependent on their relative viscosities. The valve unit and reservoir can be used with a standard, off-the-shelf bottle if desired, or the valve unit only can be used with a special, split interior bottle. The apparatus requires only a small number of relatively simple parts, which can be easily and inexpensively manufactured. The valve unit is a stand alone assembly which can be used on a standard, necked bottle. The parts may be of any suitable, non-reactive material such as relatively inert plastics material, depending on the nature of the liquids to be dispensed.

Although some preferred embodiments of the invention have been described above by way of example only, it will be understood by those skilled in the field that modifications may be made to the disclosed embodiments without departing from the scope of the invention, which is defined by the appended claims.

We claim:

1. A liquid spraying assembly for selectively dispensing at least two different liquids, comprising:

an outer container containing at least two separate compartments for containing two different liquids, the container having an outlet;

a spray pump assembly mounted on the container for dispensing liquids from the compartments; and a valve assembly connected between the compartments and the spray pump assembly for controlling the dispensing of the two different liquids, the valve assembly comprising an inner valve member having a outlet passageway for connection to the spray pump assembly, a first inlet passageway for connection to one of the liquid compartments, and a second inlet passageway for connection to the other liquid compartment, and an outer control sleeve rotatably mounted on the inner valve member, the outer control sleeve including connecting means for controlling connection of the inlet passageways to the outlet passageway, the outer control sleeve being rotatable between at least two different connects at least one of the respective inlet passageways to the outlet passageway.

2. The assembly as claimed in claim 1, wherein the control sleeve member is movable between a first position in which only the first inlet passageway is connected to the outlet passageway, a second position in which only the second inlet passageway is connected to the outlet passageway, and at least one intermediate position in which both inlet passageways are connected to the outlet passageway.

3. The assembly as claimed in claim 1, wherein the outlet passageway has an inlet opening on the outer surface of the valve member facing the inner surface of the sleeve member, and the first and second inlet passageways have respective, spaced first and second outlet openings on the outer surface of the valve member spaced from said inlet opening, and the connecting means on the inner surface of said control sleeve member comprises passageway means for controlling connection of said outlet openings to said inlet opening, said control sleeve member being rotatable between a position in which said passageway means connects only said first outlet opening to said inlet opening, a position in which said passageway means connects only said second outlet opening to said inlet opening, and a position in which both outlet openings are connected to said inlet opening via said passageway means.

4. The assembly as claimed in claim 3, wherein said inlet and outlet openings comprise axially spaced, generally parallel elongate openings.

5. The assembly as claimed in claim 1, including mounting means for releasably mounting the first valve member coaxially on the outlet of the container, the first valve member comprising a cylindrical member having securing means at its upper end for releasably securing the spray pump assembly to the valve assembly, the control sleeve member comprising a cylindrical sleeve rotatably mounted on the inner cylindrical member.

6. The assembly as claimed in claim 1, wherein the outlet passageway includes a mixing chamber having an inlet opening communicating with the outer surface of the valve member, the first inlet passageway includes a first liquid chamber, and the second inlet passageway includes a second liquid chamber, each of the liquid chambers having an outlet communicating with the outer surface of the valve member and spaced from the mixing chamber inlet opening, the control sleeve member having connecting means comprising means for controlling the connection of the first and second outlets to the mixing chamber inlet opening.

7. The assembly as claimed in claim 6, wherein the first valve member comprises a cylindrical member and the control sleeve member comprises a cylindrical sleeve rotatably mounted on the cylindrical member, the mixing chamber and liquid chambers each comprising annular grooves extending around part of the periphery of the cylindrical member and axially spaced from one another, the inlet opening and outlet openings comprising the outer radial ends of the respective grooves.

8. The assembly as claimed in claim 7, wherein one end of the mixing chamber groove is aligned with an end of one of the liquid chambers and the opposite end of the mixing chamber groove is aligned with an end of the other liquid chamber, the liquid chamber grooves each being shorter than the mixing chamber groove and extending towards one another in opposite directions from their ends aligned with the respective ends of the mixing chamber groove, the connecting means comprising a passageway extending in a direction transverse to the mixing chamber grooves and movable between a first position in which it overlaps the mixing chamber groove and the first liquid chamber groove, a second position in which it overlaps the mixing chamber groove and the second liquid chamber groove, and at least one intermediate position in which it overlaps all of the grooves to connect both liquid chambers to the mixing chamber.

9. The assembly as claimed in claim 6, wherein each of the liquid chamber outlet openings comprises an elongate opening of tapering dimensions, and the connecting means comprises a passageway on the control valve member extending in a direction transverse to the elongate outlet openings, the passageway being movable relative to the openings to vary the effective size of the respective outlet openings.

10. The assembly as claimed in claim 8, wherein at least one of the upper and lower walls of each of the liquid chambers is inclined to provide an outlet opening of tapering size from one end of the chamber to the other.

11. The assembly as claimed in claim 10, wherein the size of the outlet opening of each liquid chamber decreases from the end of the chamber aligned with a respective end of the mixing chamber towards the opposite end of the chamber.

12. The assembly as claimed in claim 1, wherein the container has an internal dividing wall separating the interior of the container into two compartments for containing different liquids.

13. The assembly as claimed in claim 1, including a removable reservoir extending from the outlet of the container into the interior of the container, the interior of said reservoir comprising one of said compartments for containing one liquid, the interior of the container surrounding the reservoir comprising the other compartment for containing a different liquid.

14. The assembly as claimed in claim 13, wherein the reservoir has spaced, parallel internal walls for defining first and second internal passageways in the reservoir, the first passageway being connected at one end to the firs inlet passageway and at the opposite end to the internal chamber of the reservoir, and the second passageway being connected at one end to the second inlet passageway and at the opposite end to the chamber surrounding the reservoir.

15. The assembly as claimed in claim 1, including releasable mounting means for releasably mounting the valve assembly co-axially on the outlet of the container, the inner and outer members and valve member outlet being co-axial with the container outlet.

16. A control valve assembly for selectively controlling the dispensing of at least two different liquids from a spray pump, comprising:

an inner valve member having a discharge outlet at a first end for connection to a spray pump draw tube, at least two inlets at a second, opposite end of said valve member for connection to liquid draw tubes extending into outlets from two different liquid chambers, an inlet opening on its outer surface intermediate its opposite ends, an internal passageway connecting said inlet opening to said discharge outlet, at least two outlet openings on its outer surface spaced from said inlet opening, and internal passageways connecting each outlet opening to a respective one of said inlets;

releasable securing means for releasably mounting the inner valve member on a container outlet;

an outer control sleeve movably mounted on the inner valve member, the control sleeve having an internal surface in mating engagement with the outer surface of said inner valve member, said internal surface having passageway means for controlling connection of said outlet openings to said inlet opening, said control sleeve being movable between positions in which only one outlet opening is connected to said inlet opening and both outlet openings are connected to said inlet opening via said passageway means; and releasable securing means for releasably mounting a spray pump on the free end of the inner valve member.

17. The assembly as claimed in claim 16, wherein said inner valve member has a mixing chamber connected between said discharge outlet and said inlet opening on the outer cylindrical surface of said inner valve member, a first liquid chamber connected between said first inlet and one of said outlet openings, and a second liquid chamber connected between said second inlet and the other outlet opening, said inlet opening and outlet openings being elongate, and said outer control sleeve has a groove on its inner surface comprising said passageway means, said groove extending in a direction transverse to said elongate outlet openings and movable between a first position overlapping the first outlet opening only, a second position overlapping the second outlet opening only, and at least one intermediate position overlapping both outlet openings, said groove communicating with said mixing chamber inlet opening in each of said positions.

18. A dual liquid spraying assembly, comprising:

an outer container having an internal chamber and an outlet opening at one end;

a spray pump mechanism mounted on the outer container, the spray pump mechanism having a suction take-up inlet tube;

a valve assembly mounted on the outlet opening of the outer container, the valve assembly comprising a first valve member having an outlet passageway for receiving said suction tube, and separate first and second inlet passageways, and a second, control valve member mounted on said first valve member and including connecting means for controlling connection of said first and second inlet passageways to said outlet passageway, the control valve member being movable relative to the first valve member between a first position in which only said first inlet passageway is connected to said outlet passageway, a second position in which only said second inlet passageway is connected to said outlet passageway, and at least one intermediate position in which both inlet passageways are connected to said outlet passageway; and a reservoir member extending from said valve assembly into the internal chamber of said outer container, the reservoir member having an internal chamber and an outer wall for separating said internal chamber from the internal chamber of said outer container, and connecting means for connecting one of said valve member inlet passageways to the internal chamber of said reservoir member and the other valve member inlet passageway to the internal chamber of said outer container surrounding said reservoir member.

19. A liquid spraying assembly for controlling the dispensing of at least two different liquids, comprising:

an outer container containing at least two separate compartments for containing two different liquids, the container having an outlet;

a spray pump assembly mounted on the container outlet for dispensing liquids from the compartments; and a valve assembly connected between the compartments and the spray pump assembly for controlling the dispensing of the two liquids, the valve assembly comprising inner and outer valve members, the outer valve member comprising an outer control sleeve rotatably mounted on the inner valve member, the inner valve member having an outlet passageway connected to said spray pump assembly, a first inlet passageway connected one of said liquid compartments, and a second inlet passageway connected to the other liquid compartment, the valve assembly including connections between said respective inlet passageways and said outlet passageway, and the outer sleeve member including means for at least partially blocking the connection between at least one of said inlet passageways and said outlet passageway, the outer sleeve member being movable relative to said first valve member between a series of different dispensing positions in which the connection between at least one of said inlet passageways and said outlet passageway is blocked by different amounts to control the proportions of said liquids dispensed.

* * * * *